US010287779B2

(12) United States Patent
Ceysson et al.

(10) Patent No.: US 10,287,779 B2
(45) Date of Patent: May 14, 2019

(54) FLOOR PANEL FOR PRODUCING A COVERING

(71) Applicant: GERFLOR, Villeurbanne (FR)

(72) Inventors: Olivier Ceysson, Bollene (FR); Bertrand Chammas, Saint-Didier-au-Mont-d'Or (FR)

(73) Assignee: GERFLOR, Villeurbanne (FR)

( * ) Notice: Subject to any disclaimer, the term of this patent is extended or adjusted under 35 U.S.C. 154(b) by 0 days.

(21) Appl. No.: 15/906,851

(22) Filed: Feb. 27, 2018

(65) Prior Publication Data

US 2018/0187423 A1 Jul. 5, 2018

Related U.S. Application Data

(63) Continuation of application No. 15/506,507, filed as application No. PCT/FR2015/052265 on Aug. 25, 2015, now Pat. No. 9,938,727.

(30) Foreign Application Priority Data

Aug. 25, 2014 (FR) ..... 14 57957

(51) Int. Cl.
*E04F 15/02* (2006.01)
*E04F 15/10* (2006.01)

(52) U.S. Cl.
CPC ..... *E04F 15/02038* (2013.01); *E04F 15/105* (2013.01); *E04F 2201/013* (2013.01);
(Continued)

(58) Field of Classification Search
CPC ..... E04F 15/02038; E04F 2201/03; E04F 2201/04; E04F 2201/045; E04F 2201/048;
(Continued)

(56) References Cited

U.S. PATENT DOCUMENTS 7,121,058 B2 10/2006 Palsson et al.
2003/0145549 A1 8/2003 Palsson et al.
(Continued)

FOREIGN PATENT DOCUMENTS

CA 2866109 A1 9/2012
DE 19718319 A1 11/1998
(Continued)

OTHER PUBLICATIONS

International Search Report issued in PCT Patent Application No. PCT/FR2015/052265 dated Dec. 3, 2015.
Written Opinion issued in PCT Patent Application No. PCT/FR2015/052265 dated Dec. 3, 2015.

*Primary Examiner* — Adriana Figueroa
*Assistant Examiner* — Jessie T Fonseca
(74) *Attorney, Agent, or Firm* — Marshall, Gerstein & Borun LLP

(57) ABSTRACT

A floor panel includes male and female coupling means that are formed by at least one proximal groove that opens onto a lower face or upper face, respectively, of the panel and by a distal flexible tongue that extends from the end of the edge of the panel towards the lower face or upper face, respectively. The tongue has a proximal wall inclined at an angle with respect to a vertical plane towards the bottom and the outside of the panel and towards the top and the outside of the panel, respectively. The tongue of at least one of the male coupling means or female coupling means has a distal wall that includes, at least, a protrusion or a notch that is able to engage with a notch or a protrusion formed in or on a proximal wall of the proximal groove of the corresponding female coupling means or male coupling means so as to form an end stop, avoiding vertical movement of a panel with respect to an adjacent panel. The flexible tongue of the female coupling means comprises a chamfered part that
(Continued)

forms an angle of between 2° and 20° with respect to the main plane of the panel.

8 Claims, 6 Drawing Sheets

(52) U.S. Cl.
CPC ..... *E04F 2201/0138* (2013.01); *E04F 2201/0146* (2013.01); *E04F 2201/023* (2013.01); *E04F 2201/03* (2013.01); *E04F 2201/04* (2013.01); *E04F 2201/042* (2013.01); *E04F 2201/043* (2013.01)

(58) Field of Classification Search
CPC ..... E04F 2201/049; E04F 15/02; E04F 2201/021; E04F 2201/023; E04F 2201/0123; E04F 2201/013; E04F 2201/0138; E04F 2201/0146; E04F 15/10
See application file for complete search history.

(56) References Cited

U.S. PATENT DOCUMENTS

| | | | |
|---|---|---|---|
| 2004/0128934 | A1 | 7/2004 | Hecht |
| 2004/0211143 | A1 | 10/2004 | Hanning |
| 2004/0250492 | A1 | 12/2004 | Becker |
| 2007/0130872 | A1 | 6/2007 | Goodwin et al. |
| 2008/0241440 | A1 | 10/2008 | Bauer |
| 2008/0245020 | A1 | 10/2008 | Kiefel et al. |
| 2009/0133353 | A1 | 5/2009 | Pervan et al. |
| 2010/0031594 | A1 | 2/2010 | Liu et al. |
| 2010/0037550 | A1 | 2/2010 | Braun |
| 2010/0293879 | A1 | 11/2010 | Pervan et al. |
| 2010/0300029 | A1 | 12/2010 | Braun et al. |
| 2011/0138722 | A1 | 6/2011 | Hannig |
| 2013/0309441 | A1 | 11/2013 | Hannig |

FOREIGN PATENT DOCUMENTS

| | | | |
|---|---|---|---|
| DE | 20206751 | U1 | 8/2002 |
| EP | 1350904 | B2 | 10/2012 |
| WO | WO-2009061279 | A1 | 5/2009 |
| WO | WO-2012001503 | A1 | 1/2012 |

FLOOR PANEL FOR PRODUCING A COVERING

TECHNOLOGICAL FIELD

This present disclosure relates to the art of floor coverings and more particularly to a floor panel for producing a floor covering or similar, said panel having the form of a plank and/or tile and being made of a plastic material such as PVC.

BACKGROUND

The production of floorings using modular elements in the form of planks and/or tiles is well known in the prior art. Their attachment to the floor is usually performed by means of gluing and/or an interlocking assembly of planks and/or tiles having male-female connection or assembly means.

Such panels are notably described in documents GB 2,256,023, EP 1,026,341 or WO 2012/004701.

GB 2,256,023 describes a joint between the adjacent lateral edges of two similar panels, wherein a panel comprises a groove with a U shape cross-section opening onto the side of the panel and wherein a second panel has a lateral tongue comprising a rib turned towards the lower face of the panel, said tongue engaging with the groove in order to limit separation of the panels.

EP 1,026,341 describes a hard floor panel for producing a floor covering. This floor panel comprises two edges on two opposing sides provided with coupling elements which confer to two adjacent panels the ability to engage with one another, said coupling elements being essentially in the form of a tongue and a groove. Said coupling means are provided with integrated mechanical locking means formed as one piece together with the panel such that when two adjacent panels are coupled, said means prevent said panels from moving away from one another in a direction perpendicular to the edges concerned and parallel to the lower face of the coupled floor panels.

WO 2012/004701 describes a floor panel that comprises a substrate and an upper layer on the substrate, the upper layer being composed of at least one print and of a transparent thermoplastic layer, said floor panel being provided, on at least two opposing edges, with a straight or curved chamfer. Moreover, both opposing edges of a panel comprise respectively a groove with a U shape cross-section opening onto the side of the panel and a lateral tongue that is able to engage with the groove in order to limit separation of the panels.

The assembly of this type of panel is performed by the oblique presentation of a panel to be positioned, which panel is presented in a position towards the anchor panel, terminating in a horizontal plane in order to be locked and in alignment with the previous one. This suggests particular shapes and also a free space in order to allow for the amplitude of movement necessary for the laying of successive panels.

Very many patents are also known in the prior art describing male-female assembly means for panels forming coverings with oblique or lateral pre-positioning in order to insert the assembly means between them. This is notably the case of the international patent applications WO 01/77461 and WO 01/53628.

This type of panel has the same drawbacks during installation and, in order to obviate these drawbacks, panels comprising male-female coupling means allowing for the vertical assembly of panels, have already been envisaged. This is notably the case of the European patent application EP 1,190,149.

EP 1,190,149 describes an attachment system for panels with retaining profiles that can be arranged on the narrow sides of the panels, wherein the mutually opposing retaining profiles of a panel are adapted to one another in such a way that adjacent panels can be attached thereto. Said retaining profiles are formed of a so-called proximal groove opening onto the lower face of the panel and onto the upper face of the panel, respectively, and of a distal tongue in the form of a hook, said hook facing the groove, extending from the end of the edge of the panel towards the lower face and, respectively, towards the upper face of said panel such that, during assembly, the tongue in the form of a hook, of a first panel, engages with the tongue in the form of a hook of a second adjacent panel.

Although this type of panel requires less free space, given that the assembly thereof is performed vertically, this type of panel nevertheless has the drawback that it requires significant assembly force and that it offers low resistance to unclipping.

Also known in the prior art is US 2013/0309441 which describes a floor panel according to the preamble of claim 1. However, the assembly/disassembly of two adjacent panels disclosed in this document is made difficult and the panel clipping/unclipping forces are mainly transmitted to the clipping protrusions which leads to rapid deterioration of these protrusions.

During the clipping of the male coupling means into the female coupling means, the flexible distal tongue of the female coupling means moves elastically in order to allow the flexible distal tongue of the male coupling means to penetrate the proximal groove of the female coupling means. However, the spacing of the tongue is counter-supported against the floor such that a force opposing the clipping is exerted against the flexible tongue of the male coupling means, which is notably transmitted to the clipping protrusion.

SUMMARY OF THE DISCLOSURE

One of the objects of the disclosed embodiments is therefore to remedy this drawback by offering a simple and inexpensive floor panel design, limiting the handling discomfort for the installer during installation of panels, especially near angles or walls, facilitating the adjustment in position of the panels, between themselves, when assembled and ensuring perfect reliability as regards the stability of the assembly, all of the panels being in the same plane after assembly without overlapping above or below with respect to their upper and lower outer surfaces.

Another object of the disclosed embodiments is to facilitate the assembly/disassembly of two adjacent panels, while avoiding the risk of deterioration of the clipping protrusions.

For this purpose, a floor panel is proposed having the form of a plank and/or tile and being made of a plastic material for producing a floor covering or similar. In a manner known in the prior art, the panel comprises at least two pairs of opposing sides defining two adjacent edges comprising male coupling means and two opposing adjacent edges comprising female coupling means. The kinematic assembly of these panels is vertical.

The male coupling means are formed of at least one so-called proximal groove opening onto a lower face of the panel and of a flexible distal tongue extending from the end of the edge of the panel towards the lower face of said panel.

The female coupling means are formed of at least one proximal groove opening onto an upper face of the panel and of a flexible tongue extending from the end of the edge of the panel, towards the upper face of said panel.

The flexible distal tongue of the male coupling means has a proximal wall inclined at an angle β with respect to a vertical plane towards the bottom and towards the outside of the panel.

The flexible tongue of the female coupling means has a proximal wall inclined at an angle α with respect to a vertical plane towards the top and towards the outside of the panel.

The distal tongue of at least one of the male coupling means or female coupling means has a distal wall comprising, at least, a protrusion or a notch that is able to engage with a notch or a protrusion formed in or on a proximal wall of the proximal groove of the corresponding female coupling means or male coupling means so as to form an end stop, avoiding vertical movement of a panel with respect to an adjacent panel.

It follows from these features that the fact that the proximal wall of the flexible tongue is oriented, makes it possible to limit the clipping forces and to promote the transfer of force for the unclipping action.

According to the embodiments described herein, the flexible tongue of the female coupling means comprises a chamfered part that forms an angle of between 2° and 20°, and preferably 10° with respect to the main plane of the panel. This chamfered part gives rise to a reduction in the clipping force such that it is easier to assemble two adjacent panels.

In fact, this range of values for the angle of the chamfered part makes it possible to implement a material recess over substantially the entire width of the flexible tongue. Thus, before clipping together two adjacent panels, the chamfered part of the flexible tongue is not in contact with the floor such that, during clipping, the tongue pivots until the chamfered part comes to rest on the floor thus limiting those forces that oppose clipping. In this way, it is easier to assemble two adjacent panels, and the risks of damaging the protrusion are reduced. The presence of the chamfer allows for deformation and mobility of the flexible tongue, this is referred to as a deformable flexible tongue.

According to a particular embodiment, the distal walls of the deformable distal tongues of the male coupling means and female coupling means comprise, respectively, a protrusion and a notch that are able to engage with a notch and a protrusion, respectively, formed in or on the proximal walls of the proximal grooves of the corresponding female coupling means and male coupling means so as to form an end stop, avoiding vertical movement of a panel with respect to an adjacent panel.

Preferably, angles α and β are between 1° and 45°, and preferably between 5° and 15°. According to a particular embodiment, angle α equals angle β.

Preferably, the proximal walls of the proximal grooves of the male coupling means and female coupling means are respectively inclined at an angle of between 1° and 45°, and preferably between 5° and 15° with respect to a vertical plane.

Preferably, the deformable flexible tongue and the proximal groove of the male coupling means, and the deformable flexible tongue and the proximal groove of the female coupling means are inclined towards the outside of the panel.

In this way, the inclinations promote the deformation of the deformable flexible distal tongue of the male coupling means and of the deformable flexible tongue of the female coupling means, limiting, during vertical clipping, the friction of the protrusion of the male coupling means against the proximal wall of the proximal groove of the female coupling means and the friction of the protrusion of the male coupling means against the distal wall of the tongue of the female coupling means. The clipping is not completely vertical but is inclined at an angle with respect to a vertical plane. This makes it possible to have better sized protrusions, safeguard said protrusions against friction, and therefore reduce the clipping force and risk of deterioration.

In addition, said inclinations promote, during unclipping, the transfer of shear forces imposed upon the protrusions to torsion/compression forces in all the profiles of the male coupling means and female coupling means, thus increasing the unclipping force.

According to a particular embodiment, the distal walls and proximal walls of the deformable flexible tongues of the male coupling means and female coupling means are parallel and inclined, respectively, at an angle with respect to a vertical plane, and the proximal walls of the proximal grooves of the male coupling means and female coupling means are parallel to the proximal walls, respectively, of the deformable flexible tongues of the male coupling means and female coupling means.

Furthermore, advantageously, the lower face of the floor panel comprises a chamfered part that opens onto the proximal groove, and forms an angle of between 2° and 20°, and preferably 10° with respect to the main plane of the panel, said chamfered part allowing for the lowering of the panel when clipping, in order to come into contact, by deformation, with the floor and thus promote the viability of said clipping.

BRIEF DESCRIPTION OF FIGURES

Further advantages and features will become clearer from the following description of several alternative embodiments, given by way of non-limiting examples, of a floor panel, with reference to the accompanying drawings wherein.

DETAILED DESCRIPTION

Figure 1:
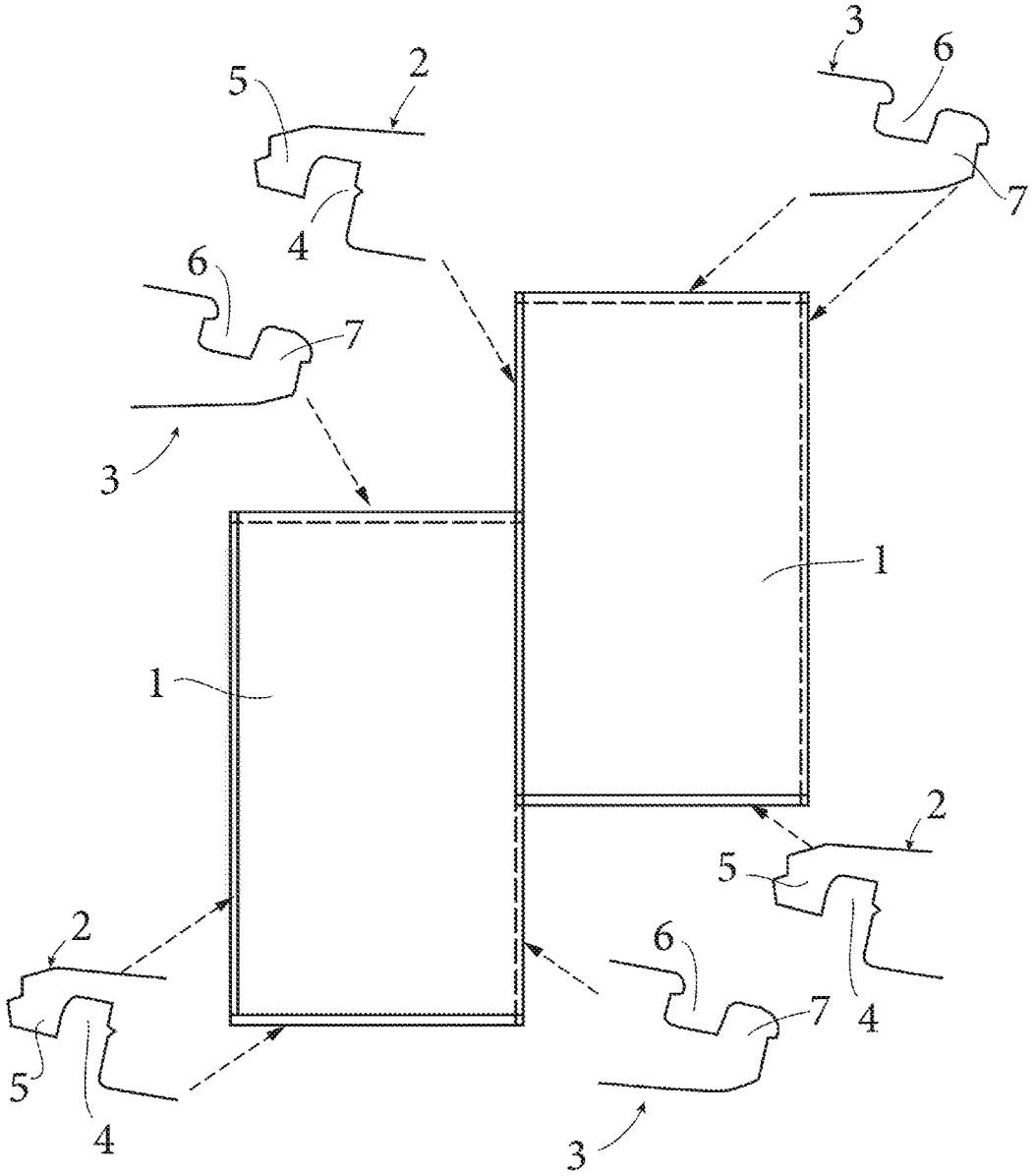
FIG. 1 is a schematic view of two adjacent panels.
Figure 2:
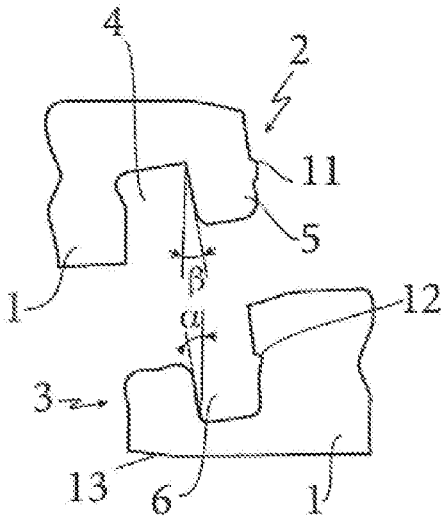
FIG. 2 is a partial cross-sectional view of an embodiment of the male coupling means and of the female coupling means of two panels, before clipping.
Figure 3:
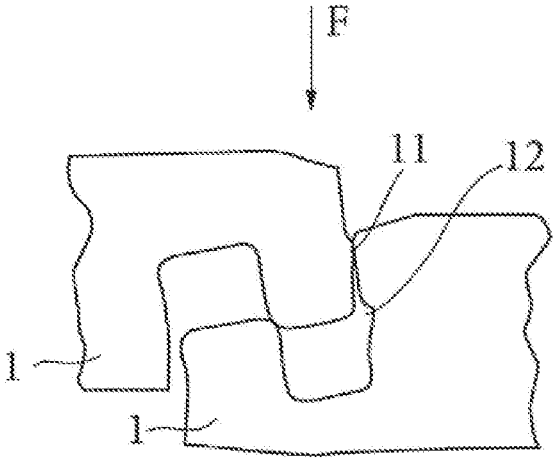
FIG. 3 is a view corresponding to FIG. 2 showing the pre-clipping of the panels.
Figure 4:
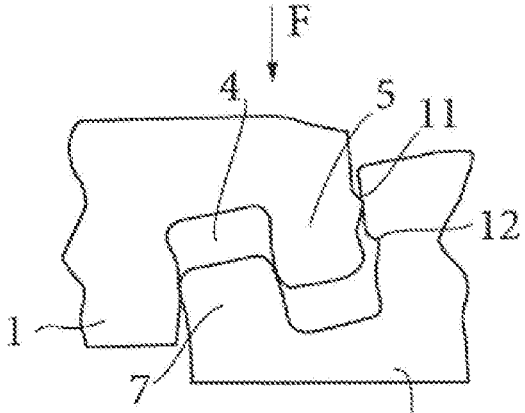
FIG. 4 is a view corresponding to FIG. 2 during clipping of the panels.
Figure 5:
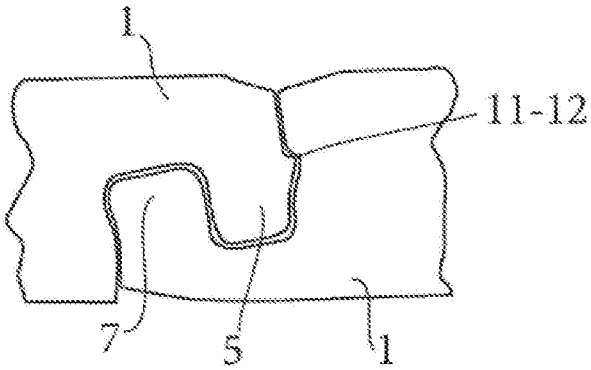
FIG. 5 is a view corresponding to FIG. 2 in the clipped position of the panels.

In the continuation of the description of the floor panel, the same reference numbers designate the same items. Furthermore, the views are not necessarily drawn to scale. In addition, the floor panels described below are preferably made of plasticized PVC and contain an inorganic filler; however, it is clear that the floor panels may be obtained of any plastic material.

Each floor panel (1) comprises two pairs of opposing sides defining the edges of the panel. Two adjacent edges comprise male coupling means (2) while adjacent two opposing edges comprise female coupling means (3). The kinematic assembly of two panels (1) is vertical according to a force (F). Said male coupling means (2) are formed of at least one so-called proximal groove (4) opening onto a lower face of the panel (1) and of a distal tongue (5) extending from the end of the edge of the panel (1) towards the lower face of said panel (1). The distal tongue (5) has a substantially rectangular cross-section. Said female coupling means (3) are formed of at least one proximal groove (6) of a substantially rectangular cross section, opening onto an upper face of the panel (1) and of a deformable flexible tongue (7) extending from the end of the edge of the panel (1), towards the upper face of said panel (1). The deformable flexible tongue (7) has a proximal wall inclined towards the top and towards the outside of the panel (1) at an angle (a) with respect to the vertical plane, such that the distal tongue (5) of the male coupling means (2) is introduced into the proximal groove (6) of the female coupling means (3) at an angle, by bearing against the deformable flexible tongue (7) which deforms in order to allow for the introduction of the distal tongue (5) into the proximal groove (6). The distal tongue (5) also deforms when introduced into the proximal groove (6).

The proximal wall of the deformable flexible tongue (7) is inclined towards the top and towards the outside of the panel (1) at an angle ($\alpha$) of between 1° and 45° with respect to the vertical, and preferably at an angle ($\alpha$) of between 5° and 15° with respect to the vertical. Moreover, the proximal groove (4) of the male coupling means (2) has a proximal wall inclined towards the bottom and towards the outside of the panel (1) at an angle ($\beta$) with respect to the vertical plane of said panel (1). Said angle ($\beta$) is between 1° and 45° and preferably between 5° and 15°. In this particular embodiment, angle ($\alpha$) is substantially equal to angle ($\beta$). It is clear that angle ($\alpha$) can be different from angle ($\beta$) without departing from the scope of the present disclosure.

Furthermore, the distal tongue (5) of the male coupling means (2) has a distal wall comprising at least one protrusion (11) that is able to engage with a notch (12) formed in a proximal wall of the proximal groove (6) so as to form an end stop, avoiding vertical movement of a panel (1) with respect to an adjacent panel.

Figure 9:
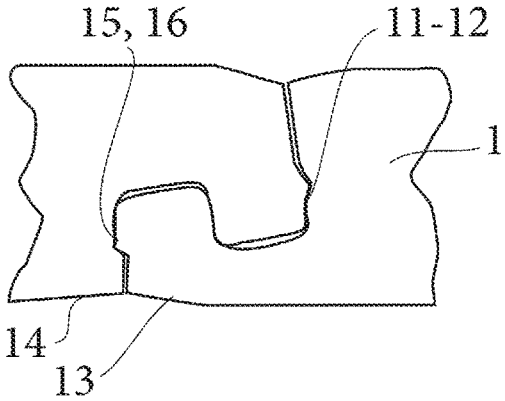
FIG. 9 is a view corresponding to FIG. 6, the panels being shown in the clipped position.
Figure 10:
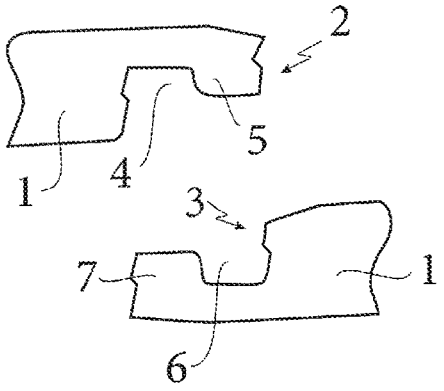
FIG. 10 is a cross-sectional view of a further embodiment of the male coupling means and of the female coupling means of two panels in the case of panels of small thicknesses, the panels being shown before clipping.
Figure 11:
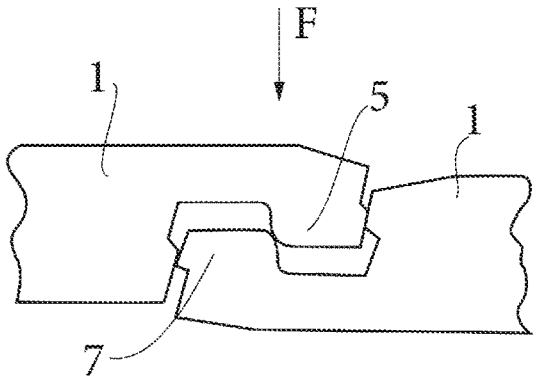
FIG. 11 is a view corresponding to FIG. 10 showing the pre-clipping of the panels.
Figure 12:
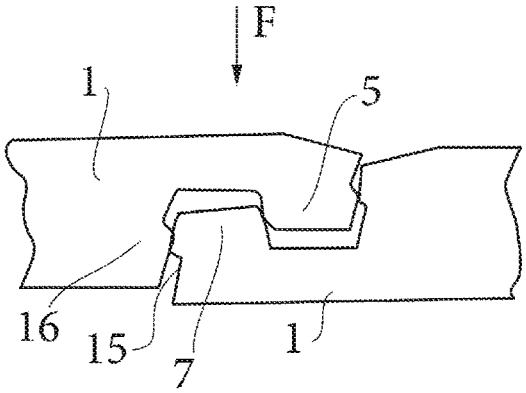
FIG. 12 is a view corresponding to FIG. 10 during clipping of the panels.
Figure 13:
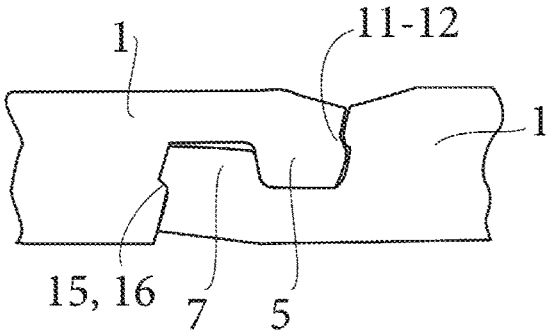
FIG. 13 is a view corresponding to FIG. 10 in the clipped position of the panels.
Figure 16:
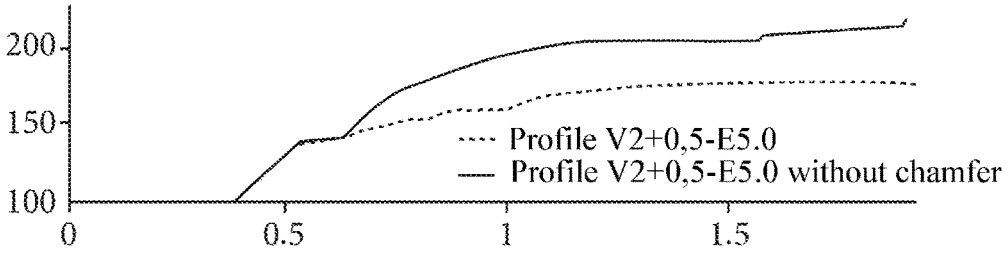
FIG. 16 is a graph showing the difference between the clipping forces for the same version of coupling means, with and without the chamfered part on the lower part of said coupling means.

According to the disclosed embodiments, and for example with reference to FIG. 9, the deformable flexible tongue (7) has a lower wall comprising a chamfered part (13) that forms an angle of between 2° and 20°, and preferably 10° with respect to the main plane of the panel (1). This chamfered part (13) gives rise to a reduction in the clipping force such that it is easier to assemble two adjacent panels. Accordingly, with reference to FIG. 16, it should be noted that the clipping force of the floor panel is significantly less than the clipping force of a floor panel with no chamfered part. This chamfered part (13) limits the clipping forces and allows for a design that is more suited to the protrusion (11). This range of values for the angle of the chamfered part (13) makes it possible to implement a material recess over substantially the entire width of the deformable flexible tongue (7). Thus, before clipping together two adjacent panels, the chamfered part (13) of the deformable flexible tongue (7) is not in contact with the floor such that, during clipping, the tongue (7) pivots until the chamfered part (13) comes to rest on the floor thus limiting those forces that oppose clipping. In this way, it is easier to assemble two adjacent panels, and the risks of damaging the protrusion (11) are reduced.

According to the embodiment shown in FIGS. 2 to 5, the deformable flexible tongue (7) has a distal wall comprising two parts, namely, an upper part inclined with respect to the vertical at an angle of between 1° and 45°, and preferably between 1° and 20° and a lower part extending vertically. The proximal wall of the proximal groove (4) also comprises two parts, namely, an upper part inclined with respect to the vertical at an angle of between 1° and 45°, and preferably between 1° and 20° in order to improve unclipping, and a lower part extending vertically, in order to improve clipping.

According to the embodiment shown in FIGS. 6 to 9, the lower face of the floor panel (1) may also comprise a chamfered part (14) that opens onto the proximal groove (4) and forms an angle of between 2° and 20°, ideally 10° with respect to the main plane of the panel (1). This chamfered part (14) allows for the lowering of the panel (1) when clipping, in order to come into contact, by deformation, with the floor and thus promote the viability of said clipping, In this embodiment, the distal wall of the deformable flexible tongue (7) also comprises an upper part inclined at an angle of between 1° and 20° with respect to the vertical and a lower part that is also inclined at an angle of between 1° and 20° with respect to the vertical. The upper and lower parts extend parallel on either side of a notch (15). The proximal wall of the proximal groove (4) also comprises two parts, an upper part inclined at an angle of between 1° and 20° with respect to the vertical, and a lower part that is inclined at an angle of between 1° and 20° with respect to the vertical. The upper and lower parts extend parallel on either side of a shoulder forming a protrusion (16) that is able to engage with the notch (15), in order to improve clipping.

It should be noted that the clipping force of the floor panels is slightly less than the clipping force of floors panels of the prior art during the first millimeters of engagement of the male and female parts, and that the unclipping force is clearly greater than that of the panels of the prior art.

Moreover, it will be observed that the orientation at an angle of between 1° and 45°, and preferably between 5° and 15° with respect to the vertical of the proximal walls of the tongues (5, 7) of the male coupling means (2) and the female coupling means (3) provides an opening for the male coupling means (2) and the female coupling means (3) during clipping such that the protrusion (11) does not rub against the proximal groove (6) thus safeguarding the protrusion (11) and reducing the clipping forces. Moreover, this orientation at an angle of between 1° and 45°, and preferably between 5° and 15° with respect to the vertical of the proximal walls of the tongues (5, 7) of the male coupling means (2) and the female coupling means (3) makes it possible to transfer the shear force of the protrusion to torsion/compression forces in all the profiles of the male parts (2) and female parts (3), thus increasing the unclipping forces.

Advantageously, the deformable flexible distal tongue (5) and the proximal groove (4) of the male coupling means (2), and the deformable flexible tongue (7) and the proximal groove (6) of the female coupling means (3) are inclined towards the outside of the panel (1). In other words, the deformable flexible distal tongues (5, 7) comprise distal walls that are substantially parallel to their proximal walls and that are notably inclined, respectively, at an angle ($\beta$, $\alpha$) with respect to a vertical plane towards the outside of the panel. In the same way, the proximal grooves (4, 6) comprise proximal walls that are substantially parallel to the proximal walls, respectively, of the deformable flexible tongues (5, 7).

Figure 17:
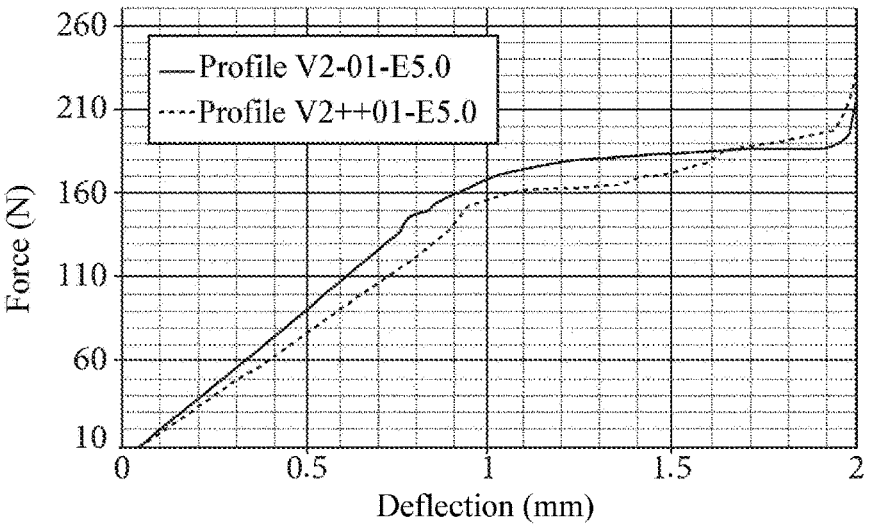
FIG. 17 is a graph showing the reduction in clipping force.

In this way, the inclinations promote the deformation of the deformable flexible distal tongue (5) of the male coupling means (2) and of the deformable flexible tongue (7) of the female coupling means (3), limiting, during vertical clipping, the friction of the protrusion (11) of the male coupling means (2) against the proximal wall of the proximal groove (6) of the female coupling means (3) and the friction of the protrusion (16) of the male coupling means (2) against the distal wall of the tongue (7) of the female coupling means (3) thus making it possible to have better sized protrusions, in order to safeguard said protrusions against friction, and therefore to reduce the clipping forces, as shown in FIG. 17.

Figure 18:
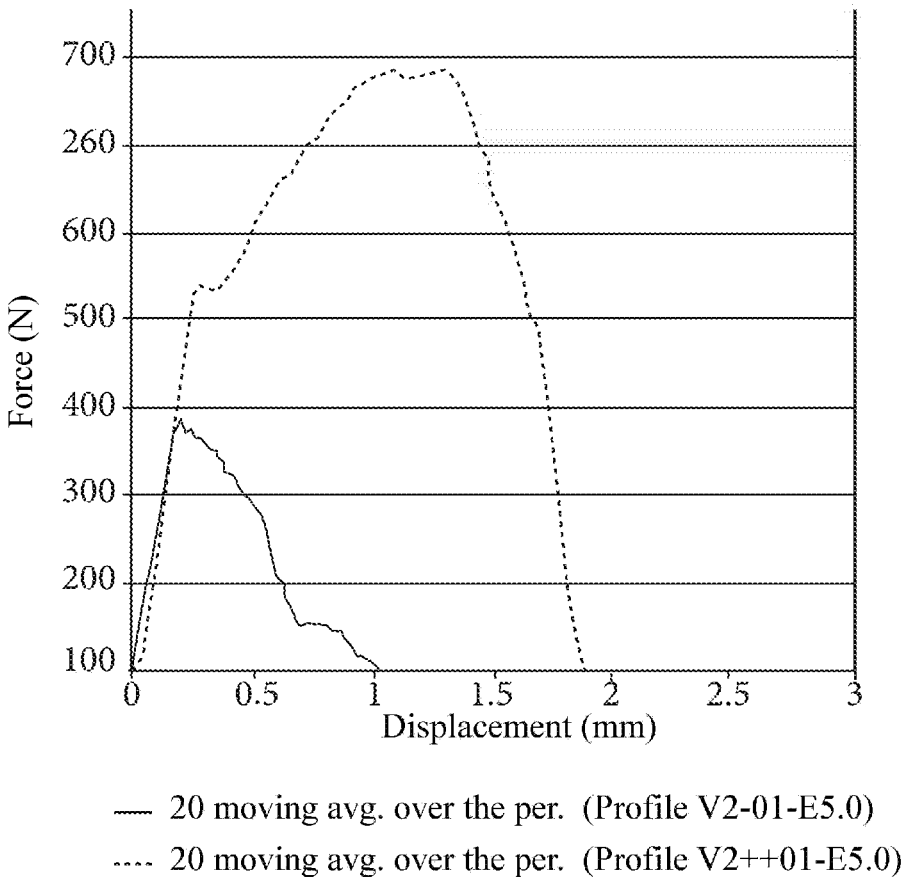
FIG. 18 is a graph showing the increase in unclipping force.

In addition, said inclinations promote, during unclipping, the transfer of shear forces imposed upon the protrusions to torsion/compression forces in all the profiles of the male parts (2) and female parts (3), thus increasing the unclipping forces, as illustrated in FIG. 18.

The alternative embodiment in reference to FIGS. 10 to 13 is particularly intended for floor panels of small thicknesses. As already indicated, each floor panel (1) comprises two pairs of opposing sides defining the edges of the panel, two adjacent edges comprising male coupling means (2) and two opposing adjacent edges comprising female coupling means (3). Said male coupling means (2) are formed of at least one so-called proximal groove (4) opening onto the lower face of the panel (1) and of a distal tongue (5) extending from the end of the edge of the panel (1) towards the lower face of said panel (1). The distal tongue (5) has a substantially rectangular cross-section. Said female coupling means (3) are formed of at least one proximal groove (6) of a substantially rectangular cross section, opening onto the upper face of the panel (1) and of a deformable flexible tongue (7) extending from the end of the edge of the panel (1), towards the upper face of said panel (1). The proximal wall of the deformable flexible tongue (7) extends at an angle of between 1° and 45°, and preferably between 5° and 15° with respect to the vertical, towards the top and towards the outside of the panel (1). Furthermore, the proximal wall of the deformable flexible tongue (5) of the male coupling means (2) also extends at an angle of between 1° and 45°, and preferably between 5° and 15° with respect to the vertical, towards the bottom and towards the outside of the panel (1).

Figure 6:
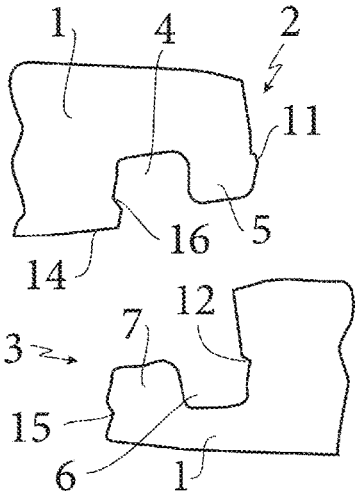
FIG. 6 is a cross-sectional view of a further embodiment of the male coupling means and of the female coupling means of two panels, the panels being shown before clipping.
Figure 7:
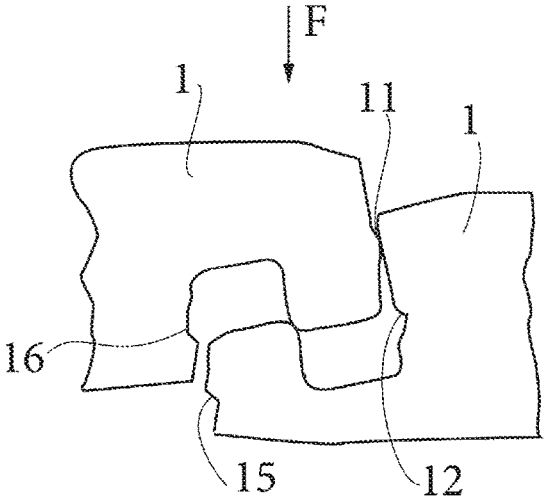
FIG. 7 is a view corresponding to FIG. 6 showing the pre-clipping of the panels.
Figure 8:
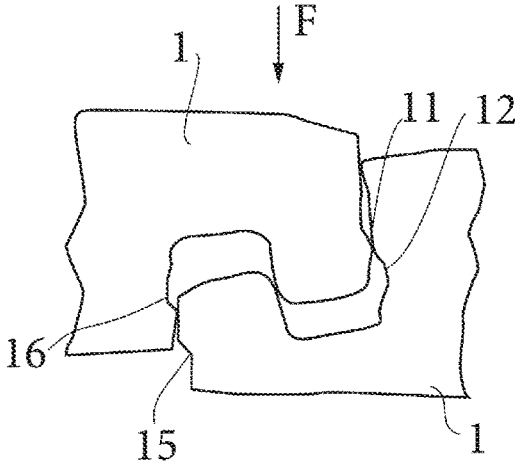
FIG. 8 is a view corresponding to FIG. 6 during clipping of the panels.

In the same way as for the embodiment shown in FIG. 6, the distal wall of the distal tongue (5) of the male coupling means (2) comprises a protrusion (11) that is able to engage with a notch (12) formed in the proximal wall of the proximal groove (6) in order to form an end stop, avoiding vertical movement of a panel (1) relative to an adjacent panel (1).

Similarly, as already indicated, the bottom wall of the deformable flexible tongue (7) comprises a chamfered part (13) which gives rise to a reduction in the clipping force such that it is easier to assemble two adjacent panels.

The distal wall of the deformable flexible groove (7) comprises two parts, an upper part inclined at an angle of between 1° and 20° with respect to the vertical, and a lower part that is also inclined at an angle of between 1° and 20° with respect to the vertical. The upper and lower parts extend parallel on either side of a notch (15). The proximal wall of the proximal groove (4) also comprises two parts, an upper part inclined at an angle of between 1° and 20° with respect to the vertical, and a lower part that is inclined at an angle of between 1° and 20° with respect to the vertical. Said upper and lower parts extend parallel on either side of a shoulder forming a protrusion (16) that is able to engage with the notch (15), in order to improve clipping.

Lastly, it is clear that the examples that have just been given are only specific illustrations and by no means limiting as concerns the scope of the claims.

Figure 14:
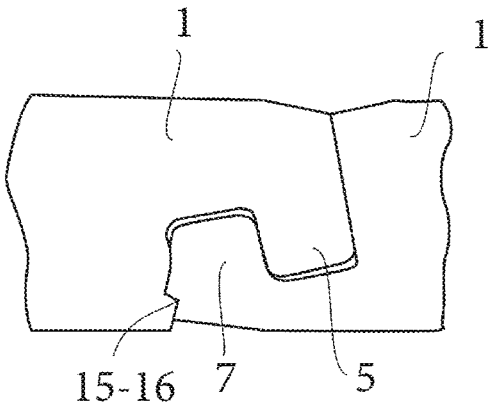
FIG. 14 is a cross-sectional view of an embodiment of the male coupling means and of the female coupling means of two panels, showing the protrusion arranged only on the female coupling means and the notch arranged only in the male coupling means.
Figure 15:
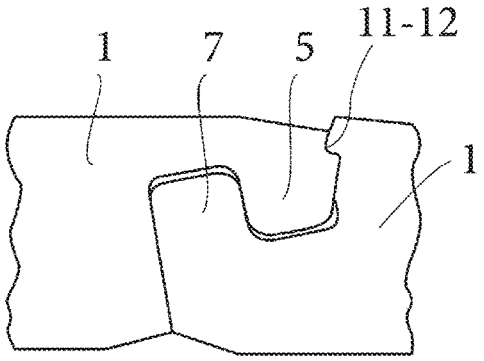
FIG. 15 is a cross-sectional view similar to that of FIG. 14, this time showing the protrusion arranged only on the male coupling means, and the notch arranged only in the female coupling means.

For example, and in reference to FIGS. 14 and 15 it is clear that the protrusion (11, 16) and the notch (12, 15) can be provided only on one of the coupling means (2, 3), or on both without departing from the scope of the contemplated embodiments.

The advantages clearly emerge from the description, and in particular, it should particularly be pointed out and recalled that:

- the clipping action has vertical kinematics but the fact that the proximal walls of the deformable flexible tongues are oriented makes it possible to limit the clipping forces and to promote the transfer of force for the unclipping action,
- the orientation causes the clipping to be opened such that the protrusion of the tongue does not rub during descent, safeguarding said protrusion and reducing the clipping forces,
- the lower chamfered part on the lower profile limits the clipping forces and allows for better sizing of the protrusion,
- the chamfered part on the upper profile makes it possible to descend lower during clipping and therefore, to promote the clipping viability.

The features of the contemplated embodiments give rise to the following technical effects and results:

When a vertical force is applied in order to assemble two panels (1) together, the deformable flexible distal tongue (5) of the male coupling means (2) comes into contact with the deformable flexible tongue (7) of the female coupling means (3); this contact causes deformation of the deformable flexible distal tongue (5) of the male coupling means (2) as well as deformation of the deformable flexible tongue (7) of the female coupling means (3); this deformation allows for the introduction of the deformable flexible distal tongue (5)

of the male coupling means (2) into the proximal groove (6) of the female coupling means (3) and the introduction of the deformable flexible tongue (7) of the female coupling means (3) into the proximal groove (4) of the male coupling means (2).

When no more vertical force is applied, the deformable flexible distal tongue (5) of the male coupling means (2) resumes its original form thus allowing the protrusion (11) of the male coupling means (2) to engage with the notch (12) of the female coupling means (3), and the deformable flexible tongue (7) of the female coupling means (3) resumes its original form thus allowing the protrusion (16) of the male coupling means (2) to engage with the notch (15) of the female coupling means (3).

When a force is applied in order to disassemble two panels (1), the engagement of the protrusion (11) of the male coupling means (2) with the notch (12) of the female coupling means (3) and that of the protrusion (16) of the male coupling means (2) with the notch (15) of the female coupling means (3) gives rise to a shear force between the protrusion (11) of the male coupling means (2) and the notch (12) of the female coupling means (3) and between the protrusion (16) of the male coupling means (2) and the notch (15) of the female coupling means (3). The shear force between the protrusion (11) of the male coupling means (2) and the notch (12) of the female coupling means (3) gives rise to deformation of the deformable flexible distal tongue (5) of the male coupling means (2); the shear force between the protrusion (16) of the male coupling means (2) and the notch (15) of the female coupling means (3) gives rise to deformation of the deformable flexible tongue (7) of the female coupling means (3). The combined deformation of the deformable flexible distal tongue (5) of the male coupling means (2) and of the deformable flexible tongue (7) of the female coupling means (3) gives rise to leading/wedging contact between the deformable flexible distal tongue (5) of the male coupling means (2) and the deformable flexible tongue (7) of the female coupling means (3). This leading contact makes it possible to transfer the shear force between the protrusion (11) of the male coupling means (2) and the notch (12) of the female coupling means (3), as well as the shear force between the protrusion (16) of the male coupling means (2) and the notch (15) of the female coupling means (3) to torsion/compression forces in all the profiles of the male parts (2) and female parts (3), thus increasing the unclipping forces.

What is claimed is:

1. A male and female coupling means of a floor panel having the form of a plank and/or tile and being made of a plastic material for producing a floor covering, comprising:

the male coupling means being formed of at least one proximal groove intended to open onto a lower horizonal plane co-planar with a lower face of the panel and of a flexible distal tongue intended to extend from one end of one edge of the panel towards the lower horizontal plane co-planar with the lower face of said panel, the female coupling means being formed of at least one proximal groove intended to open onto an upper horizontal plane co-planar with an upper face of the panel and of a flexible distal tongue intended to extend from one end of an opposite edge of the panel, towards the upper horizontal plane co-planar with the upper face of said panel, the flexible distal tongue of the male coupling means has a proximal wall inclined at an angle β with respect to a vertical plane towards the bottom of the panel and towards the outside of the panel, the flexible distal tongue of the female coupling means has a proximal wall inclined at an angle α with respect to a vertical plane towards the top of the panel and towards the outside of the panel, the flexible distal tongue of at least one of the male coupling means or female coupling means has a distal wall comprising, at least, a protrusion or a notch that is able to engage with a notch or a protrusion formed in or on a proximal wall of at least one proximal groove of the corresponding female coupling means or male coupling means of an adjacent panel so as to form an end stop, avoiding vertical movement of the panel with respect to the adjacent panel, wherein the flexible distal tongue of the female coupling means comprises a chamfered part intended to form an angle of between 2° and 20° with respect to the lower horizontal plane co-planar with the lower face of the panel, said chamfered part giving rise to a reduction in a clipping force and to a deformation of the flexible distal tongue such that it is easier to assemble two adjacent panels, and wherein the distal wall of the flexible distal tongue of the female coupling means comprises an upper part inclined at an angle of between 1° and 20° with respect to a vertical plane, and a lower part inclined at an angle of between 1° and 20° with respect to a vertical plane, the upper part and the lower part extend parallel on either side of the protrusion or of the notch, and wherein the proximal wall of the proximal groove of the male coupling means comprises an upper part inclined at an angle of between 1° and 20° with respect to a vertical plane, and a lower part inclined at an angle of between 1° and 20° with respect to a vertical plane, the upper part and the lower part extend parallel on either side of the notch or of the protrusion.

2. The male and female coupling means according to claim 1, wherein the angles α and β are between 1° and 45°.

3. The male and female coupling means according to claim 2, wherein angle α is equal to angle β.

4. The male and female coupling means according to claim 2 wherein the angles α and β are between 5° and 15°.

5. The male and female coupling means according to claim 1, wherein the chamfered part forms an angle of 10° with respect to the lower horizontal plane co-planar with the lower face of the panel.

6. The male and female coupling means according to claim 1, wherein the distal wall of the flexible distal tongue of the female coupling and proximal wall of the proximal groove of the male coupling are parallel.

7. The male and female coupling means according to claim 6, wherein the distal walls of the flexible distal tongues of the male coupling means and female coupling means comprise, respectively, a protrusion and a notch that are able to engage with a notch and a protrusion, respectively, formed in or on the proximal walls of the proximal grooves of the corresponding female coupling means and male coupling means so as to form an end stop, avoiding vertical movement of a panel with respect to an adjacent panel on which the corresponding female coupling means and male coupling are disposed.

8. The male and female coupling means according to claim 1 wherein:

the distal wall of the flexible distal tongue of the male coupling means comprises an upper part inclined at an angle of between 1° and 20° with respect to a vertical plane, and a lower part inclined at an angle of between 1° and 20° with respect to a vertical plane, the upper part and the lower part extend parallel on either side of the protrusion or of the notch, and wherein the proximal wall of the proximal groove of the female coupling means comprise each an upper part inclined at an angle of between 1° and 20° with respect to a vertical plane, and a lower part inclined at an angle of between 1° and 20° with respect to a vertical plane, the upper part and the lower part extend parallel on either side of the notch or of the protrusion.

* * * * *